US009004968B1

(12) United States Patent
Mason

(10) Patent No.: US 9,004,968 B1
(45) Date of Patent: Apr. 14, 2015

(54) FIN COVER FOR WATER VESSEL AND ASSOCIATED USE THEREOF

(76) Inventor: Karen E. Mason, Allen, TX (US)

( * ) Notice: Subject to any disclaimer, the term of this patent is extended or adjusted under 35 U.S.C. 154(b) by 0 days.

(21) Appl. No.: 13/590,132

(22) Filed: Aug. 20, 2012

Related U.S. Application Data

(60) Provisional application No. 61/524,900, filed on Aug. 18, 2011.

(51) Int. Cl.
*B63B 1/00* (2006.01)
*B63H 5/16* (2006.01)

(52) U.S. Cl.
CPC ..... *B63H 5/165* (2013.01)

(58) Field of Classification Search
CPC ..... B63B 35/7906; B63B 35/7909; B63B 35/7936; B63B 35/793; B63B 35/7926; B63B 35/81; B63B 17/02; B63B 19/02; B63B 17/00
USPC ..... 441/74, 79; 114/361
See application file for complete search history.

(56) References Cited

U.S. PATENT DOCUMENTS

| | | | | |
|---|---|---|---|---|
| 3,339,607 | A * | 9/1967 | Howard | 441/74 |
| 5,147,235 | A | 9/1992 | Bamburak et al. | |
| 5,242,322 | A * | 9/1993 | Chellemi et al. | 441/79 |
| 6,135,836 | A * | 10/2000 | Rhynsburger | 441/74 |
| D445,867 | S | 7/2001 | Reudink | |
| 6,257,941 | B1 | 7/2001 | Rhynsburger | |
| 6,394,865 | B1 | 5/2002 | Arzadon | |
| 6,918,806 | B2 * | 7/2005 | Skedeleski | 441/79 |

* cited by examiner

*Primary Examiner* — Lars A Olson

(57) ABSTRACT

A fin cover for protecting environmental surroundings from a water vessel fin during non-use of the water vessel preferably includes a body capable of receiving the water vessel fin therein. Such a body may have a reinforced closed distal end provided with a guard. The body may further have a plurality of rubber grooves located at an inner surface thereof. At least one fastener attached to the body in such a manner that the body is maintained at a substantially stable position about the water vessel fin.

11 Claims, 6 Drawing Sheets

FIN COVER FOR WATER VESSEL AND ASSOCIATED USE THEREOF

CROSS REFERENCE TO RELATED APPLICATIONS

Figure 1A:
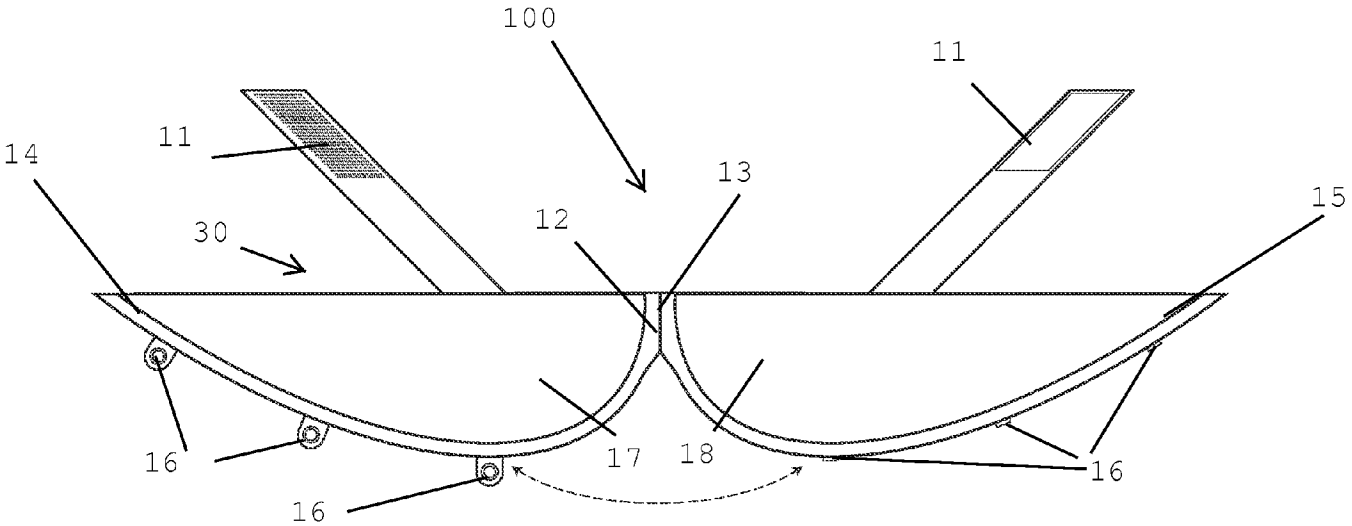

This application claims the benefit of U.S. Provisional Application No. 61/524,900 filed 18 Aug. 2011, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This non-limiting exemplary embodiment(s) relates to fin covers and, more particularly, to a fin cover for protecting the environment from various types of water vessel fins during transport of the water vessels such as surfboards, water skis and water boards, for example.

2. Prior Art

It is widely recognized that water vehicles that glide over water, such as surfboards, wakeboards, etc., have fins that extend downward into the water. Protective covers are often placed over the fins when the boards are not in use to protect them from being damaged, or to protect them from damaging other property.

Over the years, surfing boards and sail boards have evolved from solid wood paddle and surfboards to today's modern, ultra-light polyurethane foam and fiberglass composition structures. Although their maneuverability has increased as their weight decreased, the newer surfboard compositions have a significant drawback in their susceptibility to damage from abrasive materials, cracking, stress fractures and impact. Such damage does more than merely detract from the visual appearance of this relatively expensive athletic equipment. Rather, the areas most vulnerable to such damage, the side rails and the fins, are essential for effective control of the surfboard in the water. Disruption of the carefully crafted contours of the rail edges through damage causes unwanted drag which affects the balance, maneuverability and performance of the surfboard.

Moreover, crack and impact damage tend to focus the stresses of the board to the damaged area causing the injury to grow and expose more of the fragile porous foam inner core. As a result, the exposed core of a damaged surfboard is prone to the absorption of sea water which dramatically changes the symmetrical balance and handling of the board.

In the past, the majority of such damage was incurred through contact with rocks and other hard obstacles located on the sea shore when an unattended board was washed ashore by wave action after the rider was thrown from the board. However, modern day surfers utilize a tether to strap the surfboard to one of their ankles in order to prevent this occurrence. As a result, the majority of damage to modern day surfboards is incurred during storage and transit.

Prior art methods to deal with these problems have tended to involve relatively heavy, bulky, rigid surfboard cases provided with collapsible foam liners which encase the board much like a modern day guitar case. Aside from the bulk and expense of these rigid surfboard transportation cases, a serious drawback is the inability to store the case itself in a convenient location after the board has been removed for use. Such rigid cases are also difficult to mount on conventional automobile surfboard roof racks, especially when stacked in tandem, which is a common occurrence with unprotected boards.

Accordingly, a need remains for protective fin cover in order to overcome prior art shortcomings. The present disclosure satisfies such a need by providing a fin cover that is convenient and easy to use, lightweight yet durable in design, versatile in its applications, and designed for shielding an environment from the edges and tips of a water vessel fin.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a fin cover for protecting environmental surroundings from a water vessel fin during non-use of the water vessel. These and other objects, features, and advantages of the non-limiting exemplary embodiment(s) are provided by a fin cover including a flexible body having a curvilinear shape and including an open proximal end capable of receiving the water vessel fin therein. The body further has a closed distal end oppositely spaced from the open proximal end, and an outer layer formed from water-impermeable, resilient and rubber material.

In a non-limiting exemplary embodiment, at least one fastener is attached to the body in such a manner that the body is maintained at a substantially stable position about the water vessel fin.

In a non-limiting exemplary embodiment, the at least one fastener is selected from a group including: a strap, hook and loop fasteners, and a snap-button.

In a non-limiting exemplary embodiment, the body further includes a plurality of rubber grooves located at an inner surface thereof for frictionally engaging an outer surface of the water vessel fin.

In a non-limiting exemplary embodiment, the body further includes a rigid guard statically mated to the outer surface of the body and around the closed distal end. Such a closed distal end has a rounded shape.

In a non-limiting exemplary embodiment, the body further includes an eyelet, and a string tethered through the eyelet for attaching the fin cover to a support surface.

In a non-limiting exemplary embodiment, the body is bifurcated and includes a first half having a first inner edge and a first outer edge spaced therefrom, and a second half having a second inner edge and second outer edge spaced therefrom. The first inner edge is conjoined to the second inner edge. The at least one fastener includes a fastener having first and second portions coupled to the first and second outer edges, respectively. The first and second portions are connected together when the first and second half are folded together about the first and second inner edges.

In a non-limiting exemplary embodiment, the body further includes: a flexible sheath extending outwardly from the body and is capable of being removably wrapped about the water vessel. Notably, the body defines at least one fin pocket positioned a central area of the sheath and is capable of removably receiving the water vessel fin before the flexible sheath is wrapped about the water vessel.

The disclosure further includes a method of utilizing a fin cover for protecting environmental surroundings from a water vessel fin during non-use of the water vessel. Such a method comprises the chronological steps of: providing a flexible body having a curvilinear shape wherein the flexible body includes an open proximal end and a closed distal end provided oppositely spaced from the open proximal end as well as an outer layer formed from water-impermeable, resilient and rubber material; and the flexible body receiving the water vessel fin therein such that the water vessel fin is protected from environmental surroundings during non-use of the water vessel fin.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

Figure 1C:
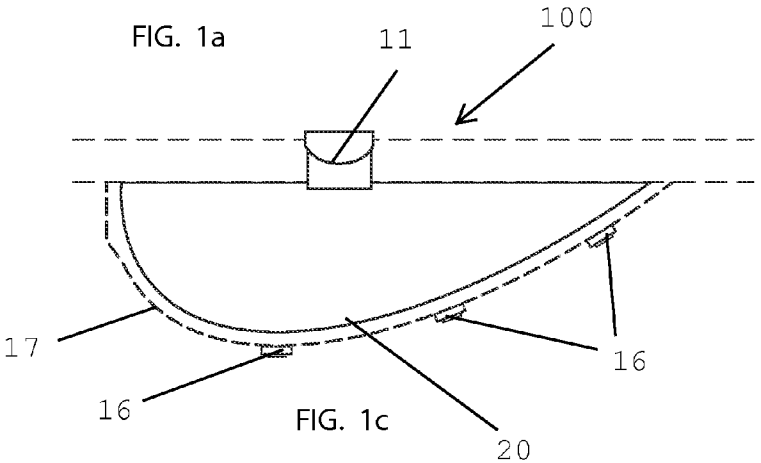
Figure 1B:
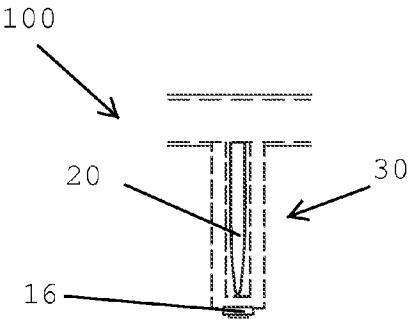

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 1*a* is a perspective view showing fin cover for protecting a water vessel fin during non-use of the water vessel, in accordance with the non-limiting exemplary embodiment(s);

FIG. 1*b* is a front elevational view of the fin cover shown in FIG. 1*a;*

FIG. 1*c* is a side elevational view of the fin cover shown in FIG. 1*a;*

Figures 2A, 2B, 2C:
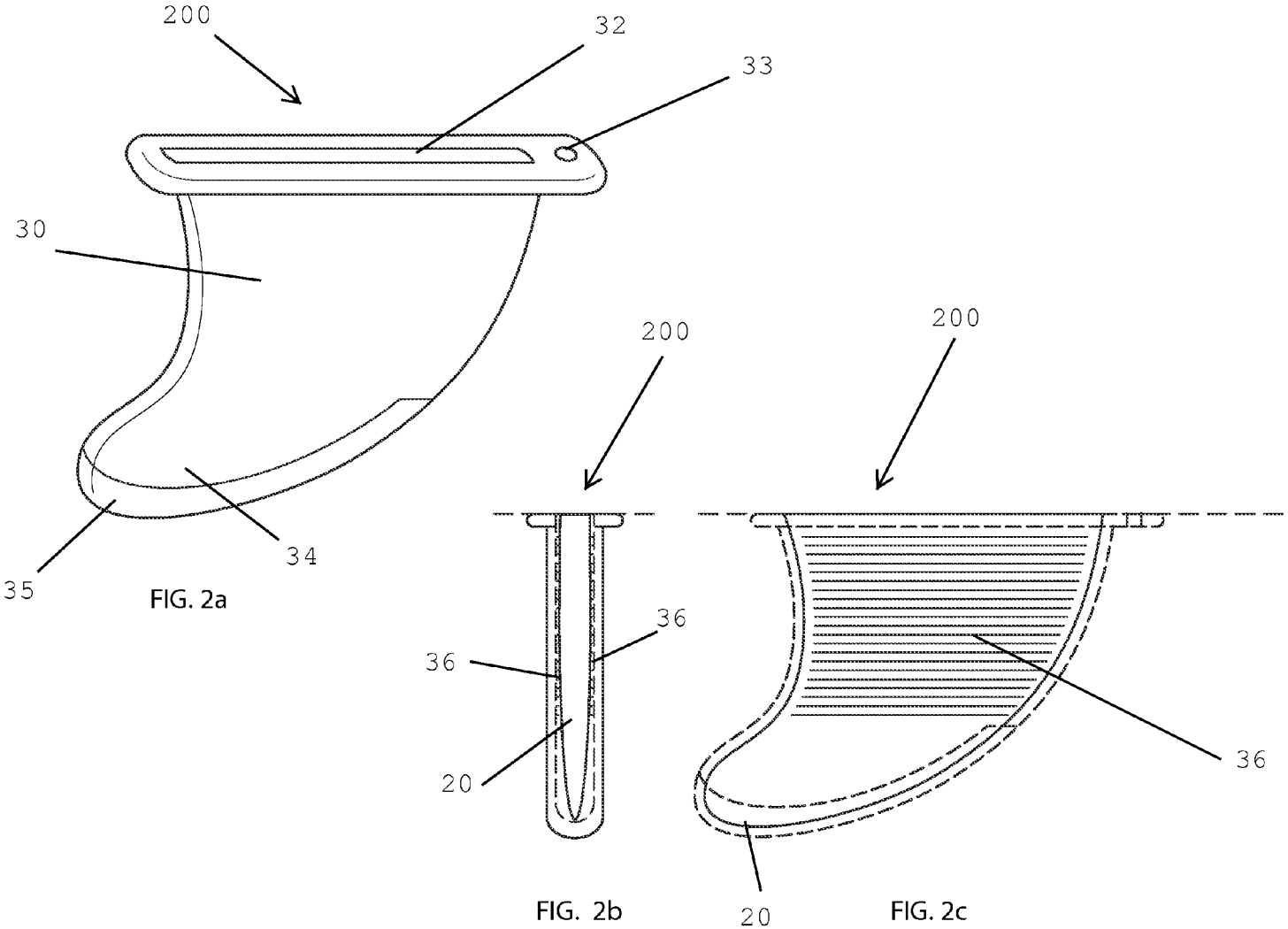

FIG. 2*a* is a perspective view showing fin cover for protecting a water vessel fin during non-use of the water vessel, in accordance with the non-limiting exemplary embodiment(s);

FIG. 2*b* is a front elevational view of the fin cover shown in FIG. 2*a;*

FIG. 2*c* is a side elevational view of the fin cover shown in FIG. 2*a;*

Figure 3A:
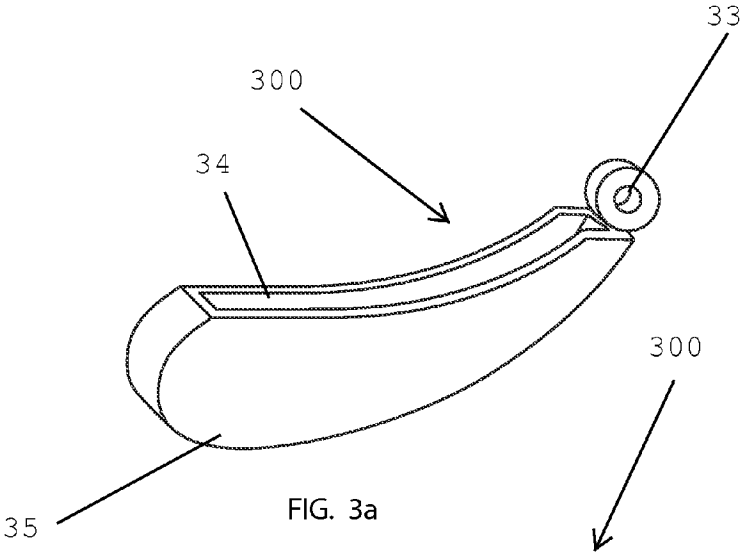
Figure 3B:
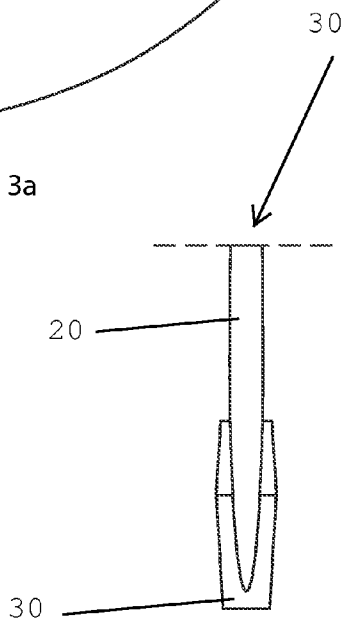

FIG. 3*a* is a perspective view showing fin cover for protecting a water vessel fin during non-use of the water vessel, in accordance with the non-limiting exemplary embodiment(s);

FIG. 3*b* is a front elevational view of the fin cover shown in FIG. 3*a;*

Figure 3C:
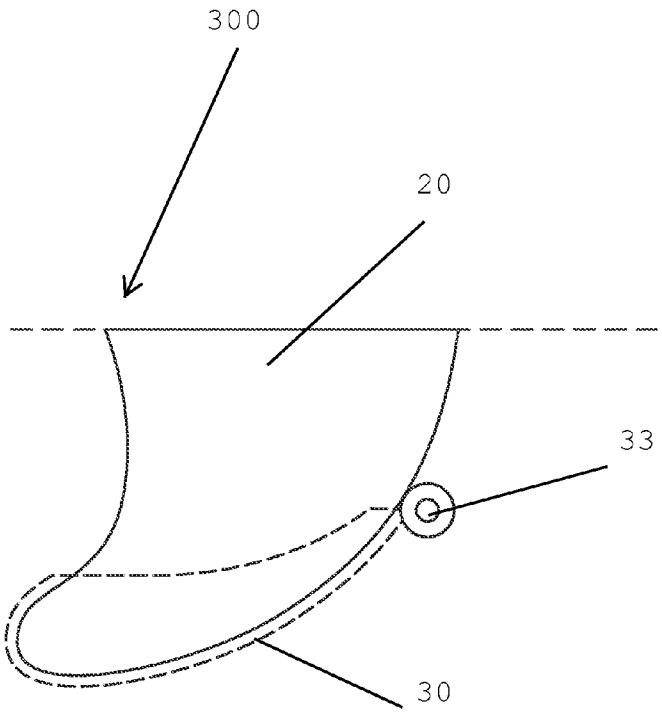

FIG. 3*c* is a side elevational view of the fin cover shown in FIG. 3*a;*

Figure 4A:
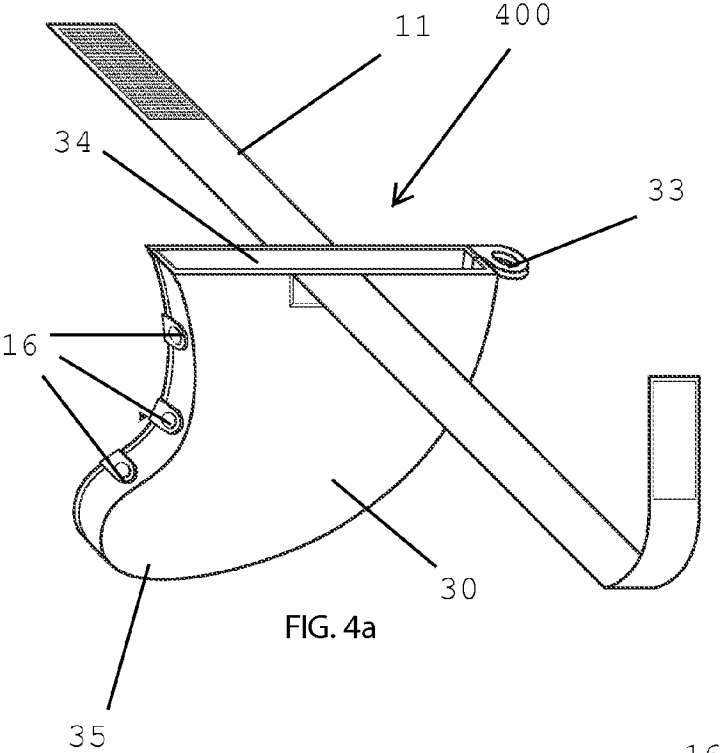
Figure 4B:
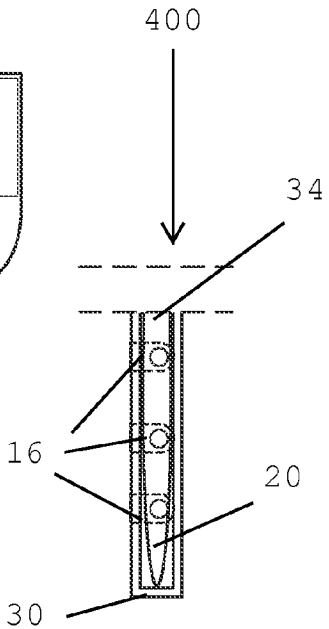

FIG. 4*a* is a perspective view showing fin cover for protecting a water vessel fin during non-use of the water vessel, in accordance with the non-limiting exemplary embodiment(s);

FIG. 4*b* is a front elevational view of the fin cover shown in FIG. 4*a;*

Figure 4C:
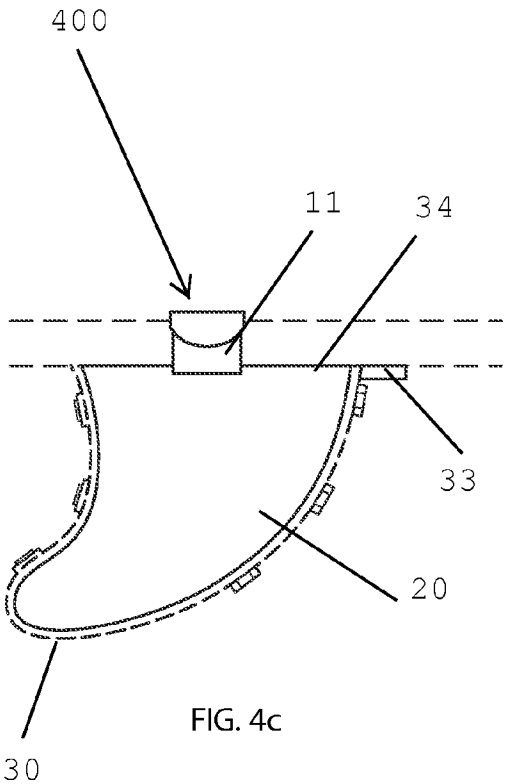

FIG. 4*c* is a side elevational view of the fin cover shown in FIG. 4*a;*

Figures 5A, 5B, 5C:
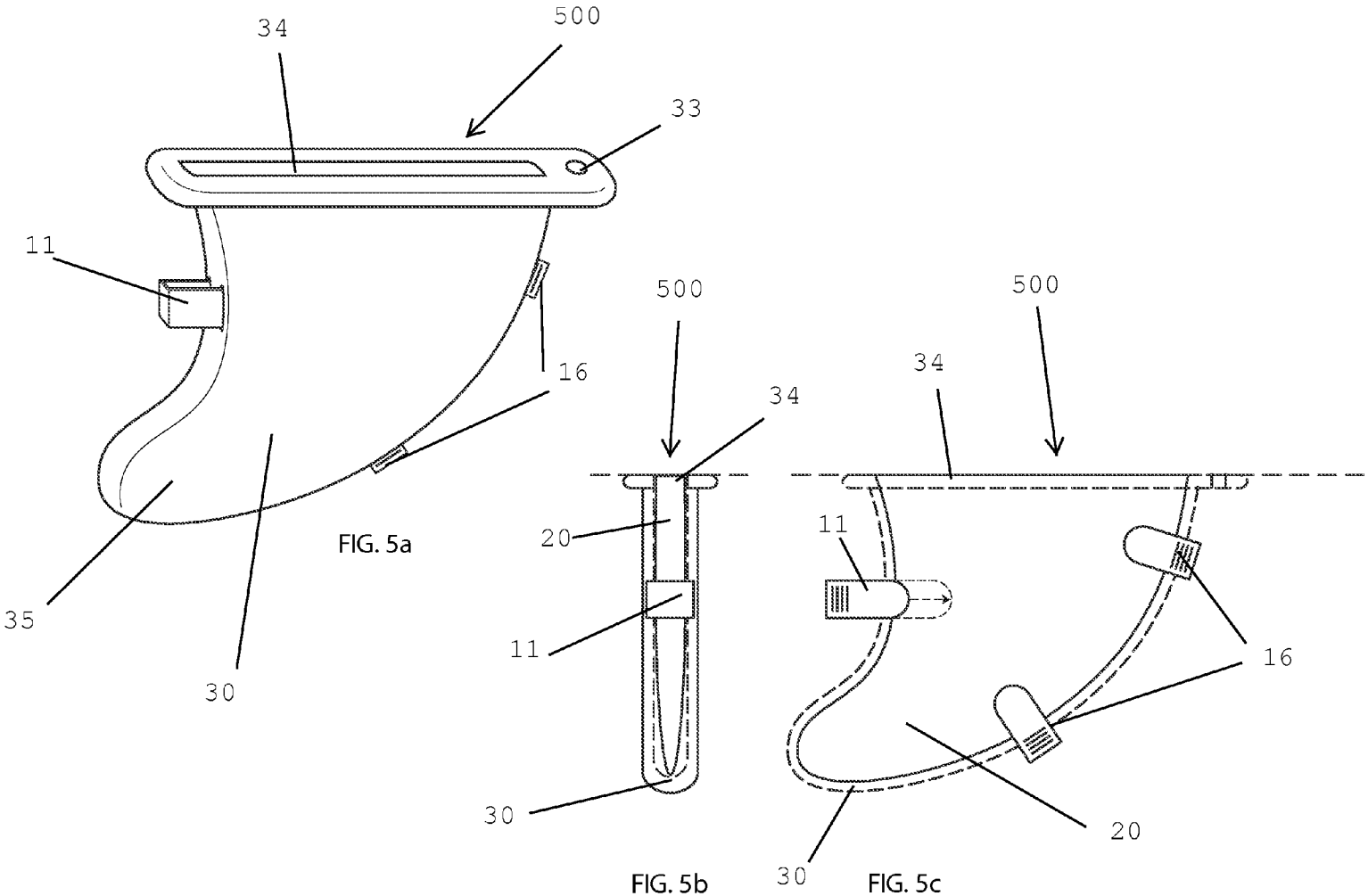

FIG. 5*a* is a perspective view showing fin cover for protecting a water vessel fin during non-use of the water vessel, in accordance with the non-limiting exemplary embodiment(s);

FIG. 5*b* is a front elevational view of the fin cover shown in FIG. 5*a;*

FIG. 5*c* is a side elevational view of the fin cover shown in FIG. 5*a;*

Figure 6A:
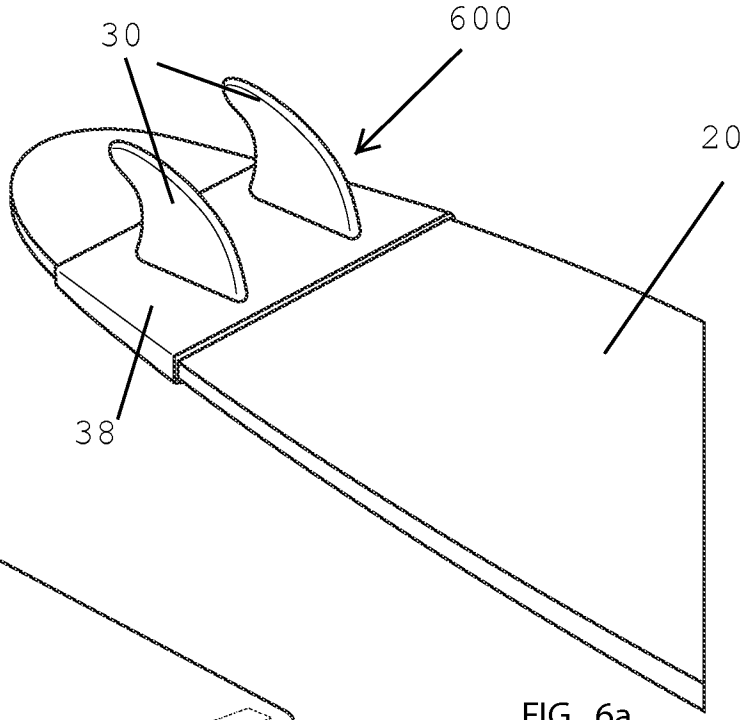
Figure 6B:
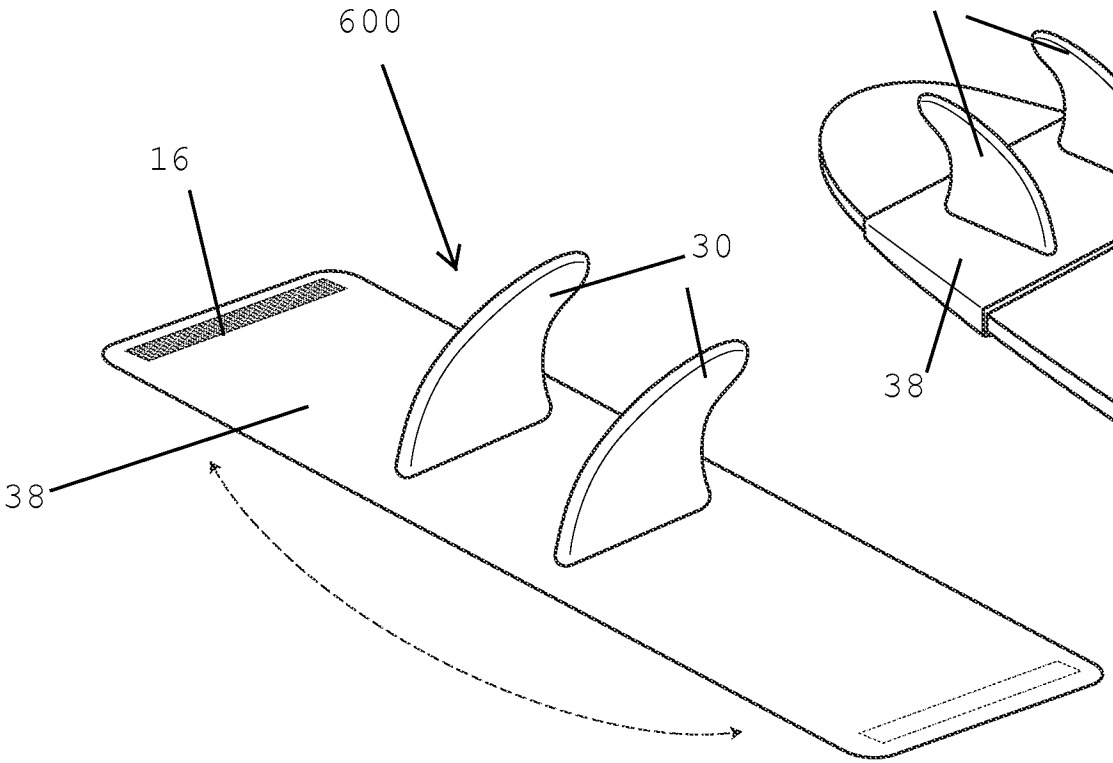

FIG. 6*a* is a perspective view showing a fin cover for protecting a water vessel fin during non-use of the water vessel, in accordance with the non-limiting exemplary embodiment(s); and FIG. 6*b* is a perspective view of the fin cover shown in FIG. 6*a* wherein the fin cover is removed from the water vessel and unfolded to an unwrapped position.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to body any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The apparatus of this disclosure is referred to generally in FIGS. 1-6*b* and is intended to provide a protective fin cover 100, 200, 300, 400, 500, 600 suitably sized and shaped to receive a surfboard fin, or the like, therein. It should be understood that the present disclosure may be used to protect many different types of fins associated with various types of water vessels, and should not be limited to any particular water vessel 20 described herein.

Referring to FIGS. 1-6*b*, a fin cover 100, 200, 300, 400, 500, 600 for protecting environmental surroundings from a water vessel fin 20 during non-use of the water vessel is disclosed. Non-limiting exemplary embodiments are identified by reference numerals 100, 200, 300, 400, 500, and 600. The fin cover 100, 200, 300, 400, 500, 600 includes a flexible body 30 having a curvilinear shape and including an open proximal end 32 capable of receiving the water vessel fin 20 therein. The body 30 further has a closed distal end 34 oppositely spaced from the open proximal end 32, and an outer layer formed from water-impermeable, resilient and rubber material.

In a non-limiting exemplary embodiment, at least one fastener 11, 16 is attached to the body 30 in such a manner that the body 30 is maintained at a substantially stable position about the water vessel fin 20.

In a non-limiting exemplary embodiment, the at least one fastener 11, 16 is selected from a group including: a strap, hook and loop fasteners, and a snap-button 11, 16.

In a non-limiting exemplary embodiment, the body 30 further includes a plurality of rubber grooves 36 located at an inner surface thereof for frictionally engaging an outer surface of the water vessel fin 20.

In a non-limiting exemplary embodiment, the body 30 further includes a rigid guard 35 statically mated to the outer surface of the body 30 and around the closed distal end 34. Such a closed distal end 34 has a rounded shape.

In a non-limiting exemplary embodiment, the body 30 further includes an eyelet 33, and a string tethered through the eyelet 33 for attaching the fin cover 100, 200, 300, 400, 500, 600 to a support surface.

In a non-limiting exemplary embodiment, the body 30 is bifurcated and includes a first half 17 having a first inner edge 12 and a first outer edge 14 spaced therefrom, and a second half 18 having a second inner edge 13 and second outer edge 15 spaced therefrom. The first inner edge 12 is conjoined to the second inner edge 13. The at least one fastener includes a fastener 11, 16 having first and second portions coupled to the first and second outer edges 17, 18, respectively. The first and second halves 17, 18 are connected and folded together about the first and second inner edges 12, 13.

In a non-limiting exemplary embodiment, the body 30 further includes: a flexible sheath 38 extending outwardly from the body 30 and is capable of being removably wrapped about the water vessel 20. Notably, the body 30 defines at least one fin pocket positioned at a central area of the sheath 38 and is capable of removably receiving the water vessel 20 fin before the flexible sheath 38 is wrapped about the water vessel 20.

The disclosure further includes a method of utilizing a fin cover 100, 200, 300, 400, 500, 600 for protecting environmental surroundings from a water vessel fin 20 during non-use of the water vessel. Such a method comprises the chronological steps of: providing a flexible body 30 having a curvilinear shape wherein the flexible body 30 includes an open proximal end 32 and a closed distal end 34 provided oppositely spaced from the open proximal end 32 as well as an outer layer formed from water-impermeable, resilient and rubber material; and the flexible body 30 receiving the water vessel fin 20 therein such that the water vessel fin 20 is protected from environmental surroundings during non-use of the water vessel fin 20.

Referring to the figures in general, in a non-limiting exemplary embodiment, the fin cover 100, 200, 300, 400, 500, 600 may be formed from water-resistant material, resilient material. An additional protective layer, such as cloth material, may be affixed to the inner and/or outer surfaces of the body 30.

In a non-limiting exemplary embodiment, the fin cover 100, 200, 300, 400, 500, 600 may be formed from non-slip rubber material wherein open proximal end 32 receives the fin 20. A closed distal end 34 may be reinforced with a more rigid guard 35 to prevent a tip of the fin 20 from damaging areas surrounding the surfboard. The inner surface of the fin cover may be provided with a plurality of rubber grooves 36 that frictional engage an outer surface of the fin 20. Such grooves 36 help maintain the fin 20 securely positioned within the fin cover. The closed distal end 34 of the fin cover 100, 200, 300, 400, 500, 600 may be rounded to aid in placement/removal of the fin inside body 30. Such a rounded distal end 34 also helps alleviate clustering/bunching of the material inside the fin cover 100, 200, 300, 400, 500, 600.

In a non-limiting exemplary embodiment, a fastener 11, 16 such as VELCRO®, a buckle strap or snap-buttons may be provided to securely maintain the fin cover about various sized fins 20. Retractable clasps may be connected to the outer surface of the fin cover. After the fin is positioned inside the fin cover, the clasps are engaged about a perimeter of the fin 20 thereby securely maintaining the fin within the fin cover. Additional fasteners 11, 16 may be employed to removably affix the fin cover 100, 200, 300, 400, 500, 600 to the surfboard.

In a non-limiting exemplary embodiment, the fin cover may be bifurcated into two halves 17, 18, which may be connected together along conjoining inner edges 12, 13 of the two halves 17, 18. Various types of fasteners 16 may be employed along outer edges of the two halves 17, 18. Such fasteners 16 are detachably affixed to each other for securing the two halves 17, 18 together. Thus, the fin cover 100 can be easily opened and closed.

In a non-limiting exemplary embodiment, a pouch may be provided to store individual fin cover therein during use of the surfboard. As an option, multiple fin covers may be individually stored inside the pouch. Alternately, a string/cable may be tethered through each eyelet 33 of each fin cover such that a group of fin covers is collectively stored together within the pouch.

In a non-limiting exemplary embodiment, a flexible body 30 may be removably wrapped about the surfboard and held in place via conventional fasteners 11, 16. At least one fin pocket may be suitably positioned along a central area of the body 30 such that a fin 20 is removably inserted into the fin pocket after the body 30 is wrapped about the surfboard.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to body all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to body all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A fin cover for protecting environmental surroundings from a water vessel fin during non-use of the water vessel, said fin cover comprising: a body including an open proximal end capable of receiving the water vessel fin therein;

a closed distal end oppositely spaced from said open proximal end; and an outer layer formed from water-impermeable, resilient and rubber material;

wherein said body comprises: a plurality of rubber grooves located at an inner surface thereof for frictionally engaging an outer surface of the water vessel fin;

wherein said body comprises a rigid guard statically mated to said outer surface of said body and around said closed distal end, wherein said closed distal end has a rounded shape;

wherein said body comprises:

an eyelet, and a string tethered through said eyelet for attaching said fin cover to a support surface.

2. The fin cover of claim 1, further comprising: at least one fastener attached to said body in such a manner that said body is maintained at a substantially stable position about the water vessel fin.

3. The fin cover of claim 2, wherein said at least one fastener is selected from a group including: a strap, hook and loop fasteners, and a snap-button.

4. The fin cover of claim 3, wherein said body is bifurcated and comprises:

a first half having a first inner edge and a first outer edge spaced therefrom; and a second half having a second inner edge and second outer edge spaced therefrom;

wherein said first inner edge is conjoined to said second inner edge;

wherein said at least one fastener comprises a fastener having first and second portions coupled to said first and second outer edges, respectively;

wherein said first and second portions are connected together when said first and second half are folded together about said first and second inner edges.

5. The fin cover of claim 3, wherein said body further comprises: a flexible sheath capable of being removably wrapped about the water vessel in such a manner that said body is positioned at a central area of the sheath and is capable of removably receiving the water vessel fin before the flexible sheath is wrapped about the water vessel.

6. A fin cover for protecting environmental surroundings from a water vessel fin during non-use of the water vessel, said fin cover comprising: a flexible body having a curvilinear shape and including an open proximal end capable of receiving the water vessel fin therein;

a closed distal end oppositely spaced from said open proximal end; and an outer layer formed from water-impermeable, resilient and rubber material;

wherein said body comprises: a plurality of rubber grooves located at an inner surface thereof for frictionally engaging an outer surface of the water vessel fin;

wherein said body comprises a rigid guard statically mated to said outer surface of said body and around said closed distal end, wherein said closed distal end has a rounded shape;

wherein said body comprises:

an eyelet, and a string tethered through said eyelet for attaching said fin cover to a support surface.

7. The fin cover of claim 6, further comprising: at least one fastener attached to said body in such a manner that said body is maintained at a substantially stable position about the water vessel fin.

8. The fin cover of claim 7, wherein said at least one fastener is selected from a group including: a strap, hook and loop fasteners, and a snap-button.

9. The fin cover of claim 8, wherein said body is bifurcated and comprises:

a first half having a first inner edge and a first outer edge spaced therefrom; and a second half having a second inner edge and second outer edge spaced therefrom;

wherein said first inner edge is conjoined to said second inner edge;

wherein said at least one fastener comprises a fastener having first and second portions coupled to said first and second outer edges, respectively;

wherein said first and second portions are connected together when said first and second half are folded together about said first and second inner edges.

10. The fin cover of claim 8, wherein said body further comprises: a flexible sheath capable of being removably wrapped about the water vessel in such a manner that said body is positioned at a central area of the sheath and is capable of removably receiving the water vessel fin before the flexible sheath is wrapped about the water vessel.

11. A method of utilizing a fin cover for protecting environmental surroundings from a water vessel fin during non-use of the water vessel, said method comprising the steps of:

providing a flexible body having a curvilinear shape, said flexible body including an open proximal end and a closed distal end provided oppositely spaced from said open proximal end, said body further including an outer layer formed from water-impermeable, resilient and rubber material, said body further including a plurality of rubber grooves located at an inner surface thereof for frictionally engaging an outer surface of the water vessel fin, said body further including a rigid guard statically mated to said outer surface of said body and around said closed distal end, wherein said closed distal end has a rounded shape; and said flexible body receiving the water vessel fin therein such that the water vessel fin is protected from environmental surroundings during non-use of the water vessel fin;

wherein said body comprises:

an eyelet, and a string tethered through said eyelet for attaching said fin cover to a support surface.

* * * * *